US011367387B1

(12) United States Patent
Yu et al.

(10) Patent No.: US 11,367,387 B1
(45) Date of Patent: Jun. 21, 2022

(54) METHOD AND IMAGE PROCESSING DEVICE FOR MURA COMPENSATION ON DISPLAY PANEL

(71) Applicant: Novatek Microelectronics Corp., Hsinchu (TW)

(72) Inventors: Wenhui Yu, Xi'an (CN); Xiaoming Bu, Xi'an (CN); Chih-Yuan Yang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/117,125

(22) Filed: Dec. 10, 2020

(51) Int. Cl.
*G09G 3/3208* (2016.01)

(52) U.S. Cl.
CPC ... *G09G 3/3208* (2013.01); *G09G 2300/0443* (2013.01); *G09G 2320/0233* (2013.01)

(58) Field of Classification Search
CPC ..... G09G 3/3208; G09G 2300/0443; G09G 2320/0233
USPC ..... 345/694
See application file for complete search history.

(56) References Cited

U.S. PATENT DOCUMENTS

| | | | | |
|---|---|---|---|---|
| 11,176,908 | B1 * | 11/2021 | Kuo | G09G 5/02 |
| 2008/0107169 | A1 * | 5/2008 | Roman | H04N 19/59 375/240 |
| 2018/0191371 | A1 * | 7/2018 | Tao | G06F 3/147 |
| 2021/0065622 | A1 * | 3/2021 | Chu | G06F 3/0418 |

* cited by examiner

*Primary Examiner* — Amare Mengistu
*Assistant Examiner* — Gloryvid Figueroa-Gibson
(74) *Attorney, Agent, or Firm* — JCIPRNET

(57) ABSTRACT

A method and an image processing device for mura detection on a display are proposed. The method includes the following steps. A compressed DeMura table corresponding to the display panel is obtained. Decompression is performed on the compressed DeMura table to generate a decompressed DeMura table. Upsampling is performed on the decompressed DeMura table to generate a reconstructed DeMura table. Mura compensation is performed on the display panel based on the reconstructed DeMura table.

19 Claims, 8 Drawing Sheets

| 0 | 1 | 2 | 3 | 4 | 5 | 6 | 7 | 8 | 9 | 10 | 11 | 12 | 13 | 14 | 15 | 16 | 17 | |
|---|---|---|---|---|---|---|---|---|---|---|---|---|---|---|---|---|---|---|
| R | G | B | G | R | G | B | G | R | G | B | G | R | G | B | G | R | G | |
| R | G | B | G | R | G | B | G | R | G | B | G | R | G | B | G | R | G | 510 |

| 0 | 1 | 2 | 3 | 4 | 5 | 6 | 7 | 8 | 9 | 10 | 11 | 12 | 13 | 14 | 15 | 16 | 17 | |
|---|---|---|---|---|---|---|---|---|---|---|---|---|---|---|---|---|---|---|
| R | G | B | G | G | R | R | G | B | G | G | B | R | G | B | G | G | R | |
| R | G | B | G | G | R | R | G | B | G | G | B | R | G | B | G | G | R | 520 |

FIG. 5A

| 0 | 1 | 2 | 3 | 4 | 5 | 6 | 7 | 8 | 9 | 10 | 11 | 12 | 13 | 14 | 15 | 16 | 17 | |
|---|---|---|---|---|---|---|---|---|---|---|---|---|---|---|---|---|---|---|
| R | G | B | G | G | R | R | G | B | G | G | B | R | G | B | G | G | R | |
| R | G | B | G | G | R | R | G | B | G | G | B | R | G | B | G | G | R | 530 |

| 0 | 1 | 2 | 3 | 4 | 5 | 6 | 7 | 8 | 9 | 10 | 11 | 12 | 13 | 14 | 15 | 16 | 17 | |
|---|---|---|---|---|---|---|---|---|---|---|---|---|---|---|---|---|---|---|
| R | G | B | G | R | G | B | G | R | G | B | G | R | G | B | G | R | G | |
| R | G | B | G | R | G | B | G | R | G | B | G | R | G | B | G | R | G | 540 |

FIG. 5B

METHOD AND IMAGE PROCESSING DEVICE FOR MURA COMPENSATION ON DISPLAY PANEL

TECHNICAL FIELD

The disclosure relates to a technique for Mura compensation on a display panel.

BACKGROUND

"Mura" defects on a display panel are contrast-type defects which appear as non-uniform brightness regions due to manufacture and assembly errors, where one or more pixels are brighter or darker than surrounding pixels. Such defects would impede the performance of the display panel and distract the user from viewing of display contents.

SUMMARY OF THE DISCLOSURE

A method and an image processing device for Mura compensation on a display panel are proposed.

According to one of the exemplary embodiments, the method includes the following steps. A compressed DeMura table corresponding to the display panel is obtained. Decompression is performed on the compressed DeMura table to generate a decompressed DeMura table. Upsampling is performed on the decompressed DeMura table to generate a reconstructed DeMura table. Mura compensation is performed on the display panel based on the reconstructed DeMura table.

According to one of the exemplary embodiments, the image processing device includes a decompression circuit, an upsampling circuit, and a compensation circuit. The decompression circuit is configured to obtain a compressed DeMura table corresponding to a display panel and perform decompression on the compressed DeMura table to generate a decompressed DeMura table. The upsample circuit is configured to perform upsampling on the decompressed DeMura table to generate a reconstructed DeMura table. The compensation circuit is configured to perform Mura compensation on the display panel based on the reconstructed DeMura table.

In order to make the aforementioned features and advantages of the disclosure comprehensible, preferred embodiments accompanied with figures are described in detail below. It is to be understood that both the foregoing general description and the following detailed description are exemplary, and are intended to provide further explanation of the disclosure as claimed.

It should be understood, however, that this summary may not contain all of the aspect and embodiments of the disclosure and is therefore not meant to be limiting or restrictive in any manner. Also, the disclosure would include improvements and modifications which are obvious to one skilled in the art.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

FIG. 5A illustrates a schematic diagram of a reordering process carried out at an encoder side in accordance with one of the exemplary embodiments of the disclosure.

FIG. 5B illustrates a schematic diagram of an inverse-reordering process carried out at a decoder side in accordance with one of the exemplary embodiments of the disclosure.

Figure 1:
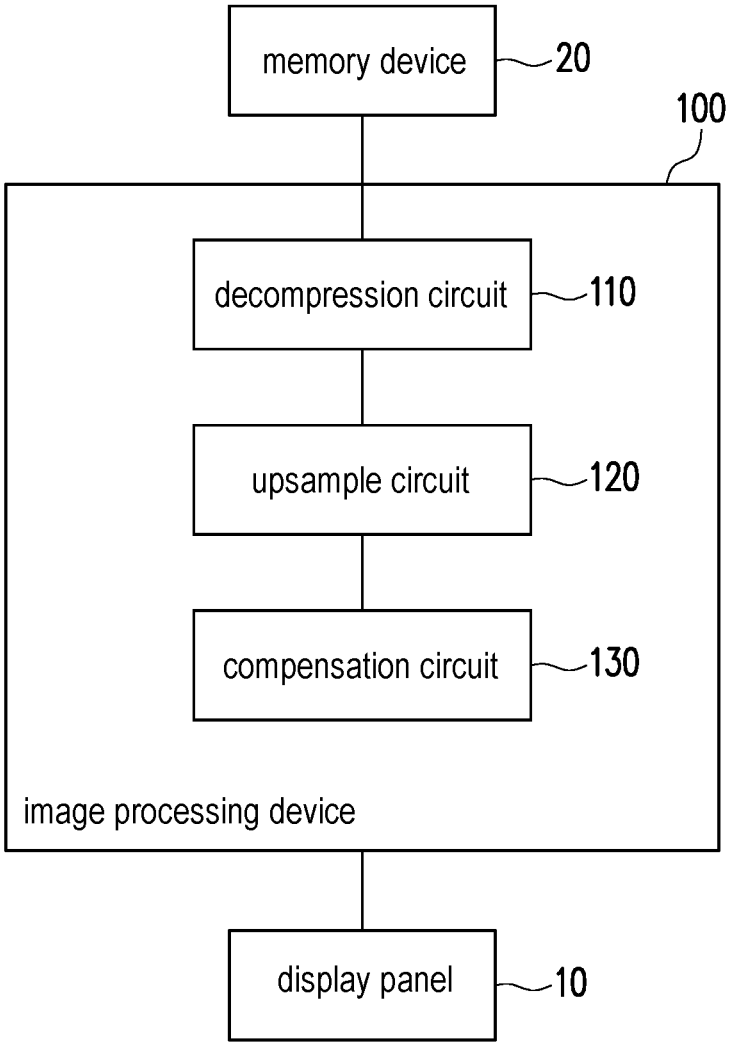
FIG. 1 illustrates a schematic diagram of a proposed image processing device in accordance with one of the exemplary embodiments of the disclosure.

To make the above features and advantages of the application more comprehensible, several embodiments accompanied with drawings are described in detail as follows.

DESCRIPTION OF THE EMBODIMENTS

Some embodiments of the disclosure will now be described more fully hereinafter with reference to the accompanying drawings, in which some, but not all embodiments of the application are shown. Indeed, various embodiments of the disclosure may be embodied in many different forms and should not be construed as limited to the embodiments set forth herein; rather, these embodiments are provided so that this disclosure will satisfy applicable legal requirements. Like reference numerals refer to like elements throughout.

FIG. 1 illustrates a schematic diagram of a proposed image processing device in accordance with one of the exemplary embodiments of the disclosure. All components of the image processing device and their configurations are first introduced in FIG. 1. The functionalities of the components are disclosed in more detail in conjunction with FIG. 2.

Referring to FIG. 1, an image processing device 100 for Mura compensation on a display panel 10 in the present exemplary embodiment would include a decompression circuit 110, an upsample circuit 120 coupled to the decompression circuit 110, and a compensation circuit 130 coupled to the upsample circuit 120. The image processing device 100 may be implemented as integrated circuits and configured to implement the proposed method after reading a DeMura table stored in a memory device 20 (e.g. a flash device) the following exemplary embodiments.

Figure 2:
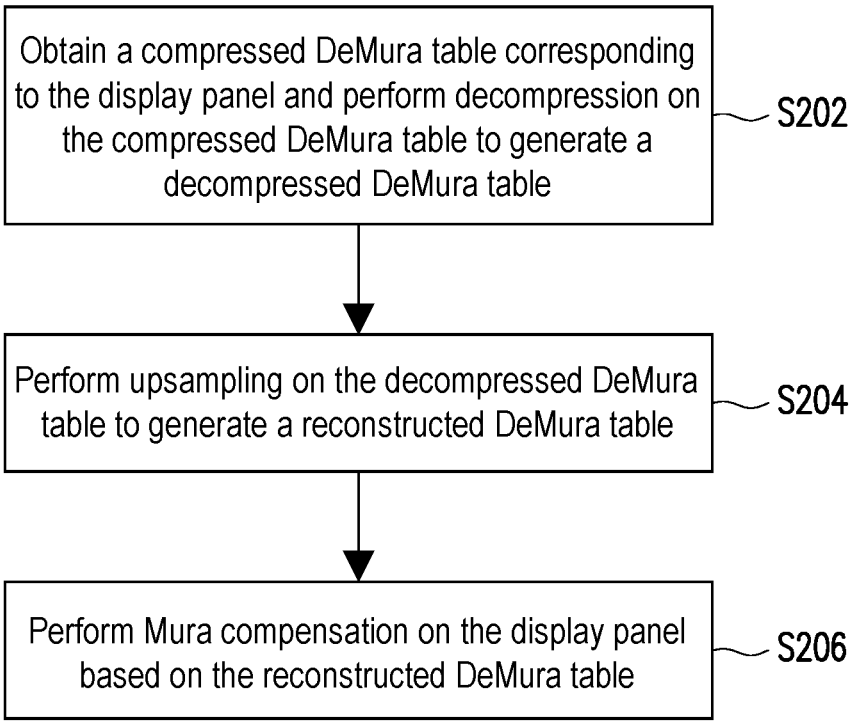
FIG. 2 illustrates a flowchart of a proposed method for Mura compensation on a display panel in accordance with one of the exemplary embodiments of the disclosure.

FIG. 2 illustrates a flowchart of a proposed method for Mura compensation on a display panel in accordance with one of the exemplary embodiments of the disclosure. The steps of FIG. 2 could be implemented by the proposed image processing device 100 as illustrated in FIG. 1.

Referring to FIG. 2 in conjunction to FIG. 1, the decompression circuit 110 of the image processing device 100 would obtain a compressed DeMura table corresponding to the display panel 10 by, for example, reading bitstreams from the memory device 20 and perform decompression on the compressed DeMura table to generate a decompressed DeMura table (Step S202). Next, the upsample circuit 120 would perform upsampling on the decompressed DeMura table to generate a reconstructed DeMura table (Step 204), and then the compensation circuit 130 would perform Mura compensation on the display panel 10 based on the reconstructed DeMura table (Step S206). Note that such upsampling process may be performed on a basis of how the DeMura table was processed prior to being stored in the memory device 20. In other words, the proposed image processing device 100 may be considered as a decoder side, and a computer system that creates the DeMura table may be considered as an encoder side. Since the human eyes are not equally sensitive to each color channel (less sensitive to blue (B) than to green (G) or red (R)), the encoder side would downsample the data in the DeMura table on some color channels to improve compression quality, and the decoder side would decompress and upsample the received data to restore the original amount of data in the DeMura table. More details would be provided hereafter for better comprehension.

Figure 3A:
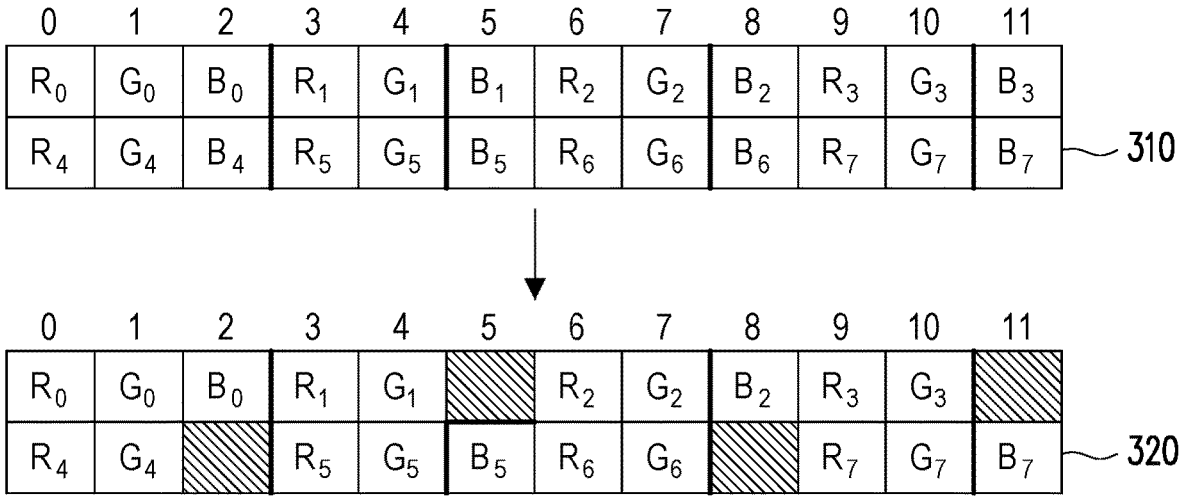
FIG. 3A illustrates a schematic diagram of a downsampling process carried out at an encoder side in accordance with one of the exemplary embodiments of the disclosure.
Figure 3B:
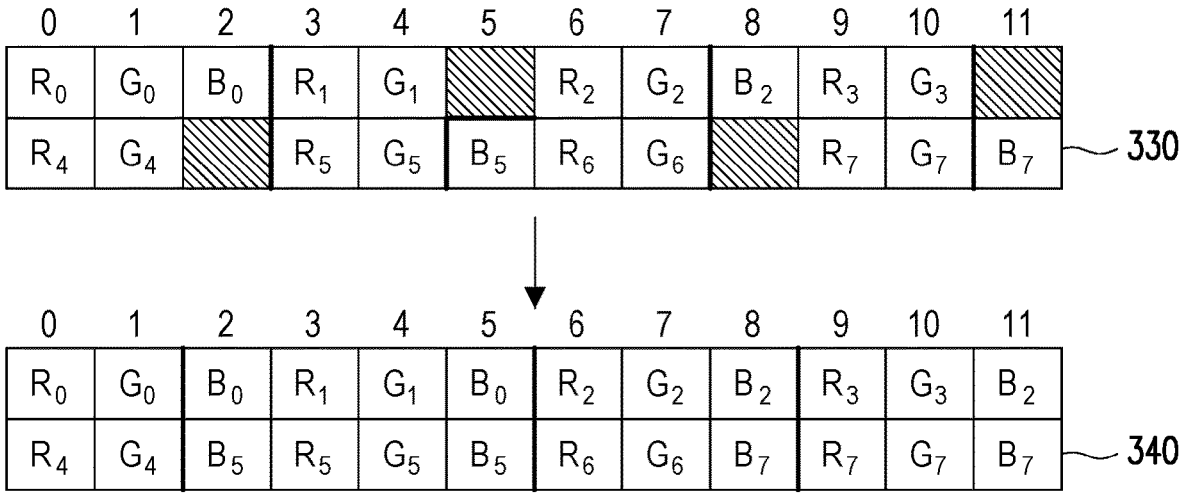
FIG. 3B illustrates a schematic diagram of an upsampling process carried out at a decoder side in accordance with one of the exemplary embodiments of the disclosure.

FIG. 3A illustrates a schematic diagram of a downsampling process carried out at an encoder side in accordance with one of the exemplary embodiments of the disclosure, and FIG. 3B illustrates a schematic diagram of an upsampling process carried out at a decoder side in accordance with one of the exemplary embodiments of the disclosure. In the present exemplary embodiment, the display panel 10 would be an RGB OLED display panel, where sub-pixels of each pixel of the display panel 10 would include an R subpixel, a G subpixel, and a B subpixel.

Referring to FIG. 3A, a DeMura table 310 would be downsampled such that the data located at designated positions and corresponds to a portion of the B subpixels of the display panel 10 in the DeMura table 310 would be removed. For example, the data corresponding to the B subpixels at positions 6m-1 in the odd rows (e.g. $B_1$, $B_3$) as well as the data at positions 6m-4 in the even rows (e.g. $B_4$, $B_6$) in the DeMura table 310 would be removed to produce a DeMura table 320, where m are positive integers. The DeMura table 320 would be compressed and stored in the memory device 20. It should be noted that the data corresponding to the R subpixels may also be downsampled in some exemplary embodiments. Since the human eyes are less sensitive to blue than to red, the amount of the data corresponding to the B subpixels designated to be downsampled may be larger than or equal to the amount of the data corresponding to the R subpixels designated to be downsampled. On the other hand, since the human eyes are most sensitive to green, the data corresponding to the G subpixels would not be designated to be downsampled unless in an inevitable scenario.

Next, referring to FIG. 3B in conjunction to FIG. 3A and FIG. 1, the decompression circuit 110 of the image processing device 100 would obtain the compressed DeMura table 320 from the memory device 20 and perform decompression on the compressed DeMura table to generate a decompressed DeMura table 330. Note that the compressed DeMura table 320 and the decompressed DeMura table 330 would both correspond to the same arrangement of subpixels and yet with different values due to compression and decompression as known per se. Herein, the decompressed DeMura table 330 would include missing data due to downsampling in the encoder side as well as decompressed data. In other words, the decompressed DeMura table 330 would include missing data corresponding to a portion of the B subpixels and non-missing data. The upsample circuit 120 would perform upsampling on the decompressed DeMura table 330 by performing data imputation on the missing data in the decompressed DeMura table 330 to generate a reconstructed DeMura table 340. Any data imputation technique as known per se may be leveraged, and the disclosure is not limited in this regard.

Herein, data imputation may be performed on the missing data corresponding to the B subpixel of any pixel based on non-missing data of the B subpixel of at least one neighboring pixel (e.g. adjacent B subpixel with non-missing data on the same row in the DeMura table 330). For example, the missing data corresponding to the B subpixel in the even row at position 2 in the DeMura table 330 would be imputed by the non-missing data corresponding to the right-adjacent B subpixel (i.e. $B_5$), and the missing data corresponding to the B subpixel in the odd row at position 5 in the DeMura table 330 would be imputed by the non-missing data corresponding to the left-adjacent B subpixel (i.e. $B_0$).

In a case where the display panel 10 is an RGBG OLED display panel, the compression and decompression processes would be similar to those as presented in FIG. 3A and FIG. 3B except that an additional pixel reordering process would be performed. The pixel reordering process is to ensure that DeMura data of different color channels would be located at specific positions for downsampling and compression purposes. From another perspective, the pixel reordering process is to ensure that DeMura data of certain color channels (e.g. G color channel) that human eyes are more sensitive to would not be downsampled.

Figure 4:
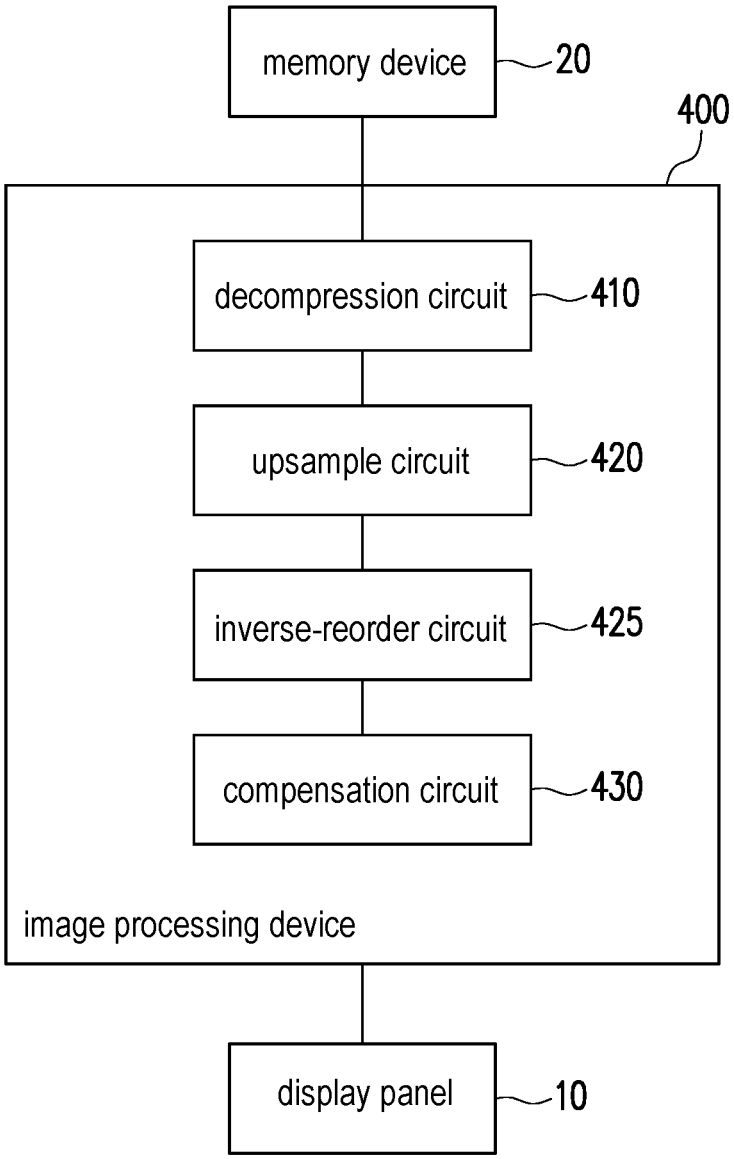
FIG. 4 illustrates a schematic diagram of a proposed image processing device in accordance with one of the exemplary embodiments of the disclosure.

In detail, FIG. 4 illustrates a schematic diagram of a proposed image processing device in accordance with one of the exemplary embodiments of the disclosure.

Referring to FIG. 4, an image processing device 400 for Mura compensation on a display panel 10 (e.g. an OLED display) in the present exemplary embodiment would include a decompression circuit 410, an upsample circuit 420 coupled to the decompression circuit 410, an inverse-reorder circuit 425 coupled to the upsample circuit 420, and a compensation circuit 430 coupled to the inverse-reorder circuit 425. The image processing device 100 may be implemented as integrated circuits and configured to implement the proposed method after reading a DeMura table stored in a memory device 20 (e.g. a flash device) the following exemplary embodiments.

In detail, FIG. 5A illustrates a schematic diagram of a reordering process carried out at an encoder side in accordance with one of the exemplary embodiments of the disclosure, and FIG. 5B illustrates a schematic diagram of an inverse-reordering process carried out at a decoder side in accordance with one of the exemplary embodiments of the disclosure.

Referring to FIG. 5A, a DeMura table 510 would be reordered to a DeMura table 520 at the encoder side such that G subpixels are in the positions of 3k or 3k+1 and B is in the position 3k+2, where k are non-negative integers. The DeMura table 520 would be compressed and stored in the memory device 20 along with reordering information (e.g. the scheme of how the DeMura table 510 has been reordered).

Referring to FIG. 5B, the DeMura table 530 (with the same pixel order as the DeMura table 520 after being processed), would be inverse-reordered to a DeMura table 540 (with the same pixel order as the original DeMura table 510) according to the reordering information.

Figure 6A:
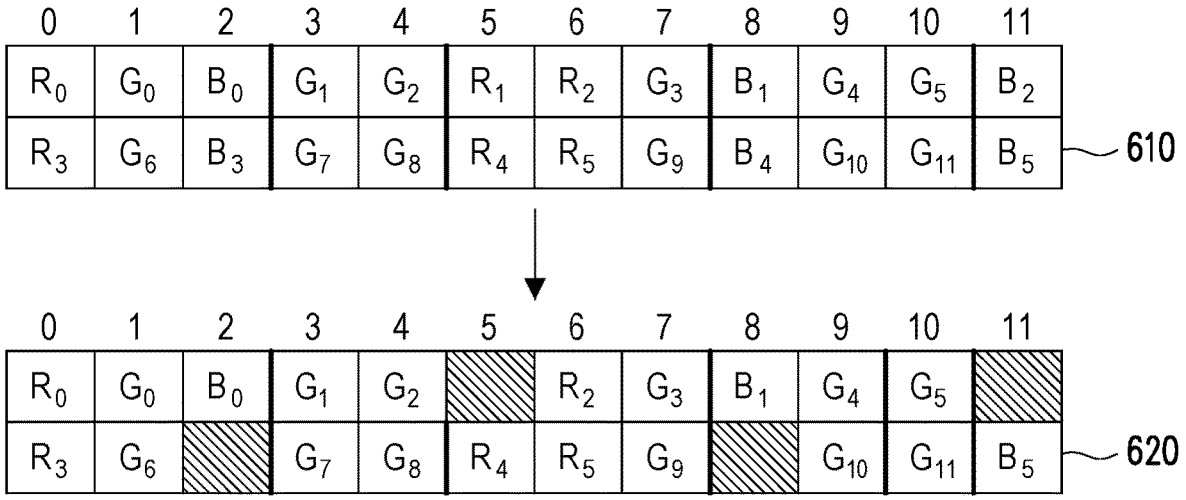
FIG. 6A illustrates a schematic diagram of a downsampling process carried out at an encoder side in accordance with one of the exemplary embodiments of the disclosure.
Figure 6B:
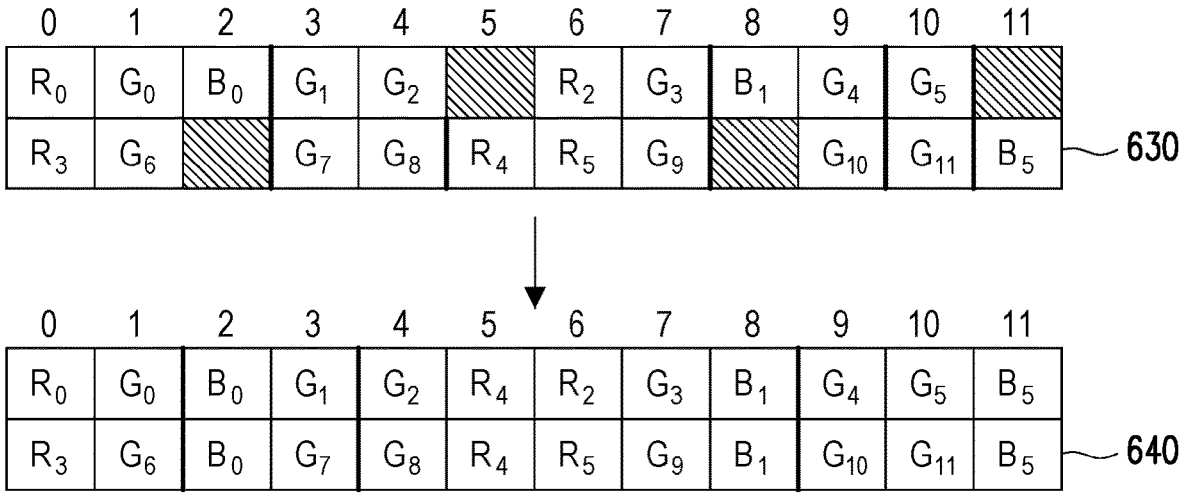
FIG. 6B illustrates a schematic diagram of an upsampling process carried out at a decoder side in accordance with one of the exemplary embodiments of the disclosure.

FIG. 6A illustrates a schematic diagram of a downsampling process carried out at an encoder side in accordance with one of the exemplary embodiments of the disclosure, and FIG. 6B illustrates a schematic diagram of an upsampling process carried out at a decoder side in accordance with one of the exemplary embodiments of the disclosure. In the present exemplary embodiment, the display panel 10 would be an RGBG OLED display panel, where sub-pixels of each pixel of the display panel 10 would include an R subpixel, two G subpixels, and a B subpixel. Note that a table reordering process has been performed prior to the process illustrated in FIG. 6A.

Referring to FIG. 6A, a reordered DeMura table 610 would be downsampled such that the data located at designated positions in the DeMura table 610 would be removed. The removed DeMura data may correspond to a portion of the B subpixels of the display panel 10 and may further correspond to a portion of the R subpixels of the display panel 10. For example, the data at positions 6m-1 in the odd rows (e.g. $R_1$, $B_2$) as well as the data at positions 6m-4 in the even rows (e.g. $B_3$, $B_4$) in the DeMura table 610 would be removed to produce a DeMura table 620, where m are positive integers. The DeMura table 620 would be compressed and stored in the memory device 20.

Next, referring to FIG. 6B in conjunction to FIG. 4, the decompression circuit 410 of the image processing device 400 would obtain the compressed DeMura table from the memory device 20 and perform decompression on the compressed DeMura table to generate a decompressed DeMura table 630. Note that the compressed DeMura table 620 and the decompressed DeMura table 630 would both correspond to the same arrangement of subpixels and yet with different values due to compression and decompression as known per se. Herein, the decompressed DeMura table 630 would include missing data due to downsampling in the encoder side as well as decompressed data. In other words, the decompressed DeMura table 630 would include missing data corresponding to a portion of the B subpixels and the R subpixels as well as non-missing data. The upsample circuit 420 would perform upsampling on the decompressed DeMura table 630 by performing data imputation on the missing data in the decompressed DeMura table 630 to generate a upsampled DeMura table 640. Any data imputation technique as known per se may be leveraged, and the disclosure is not limited in this regard.

Herein, data imputation may be performed on the missing data corresponding to the B subpixel of any pixel based on non-missing data of the B subpixel of at least one neighboring pixel. For example, the missing data corresponding to the B subpixel in the even row at position 2 in the DeMura table 630 would be imputed by the non-missing data corresponding to the upper-adjacent B subpixel (i.e. $B_0$). The missing data of the R subpixel of any pixel may be imputed in a similar fashion. Note that the inverse-reorder circuit 425 would further inverse reorder the upsampled DeMura table 640 to generate a reconstructed DeMura table (not shown) according to the reorder information obtained from the memory 20.

Figure 7:
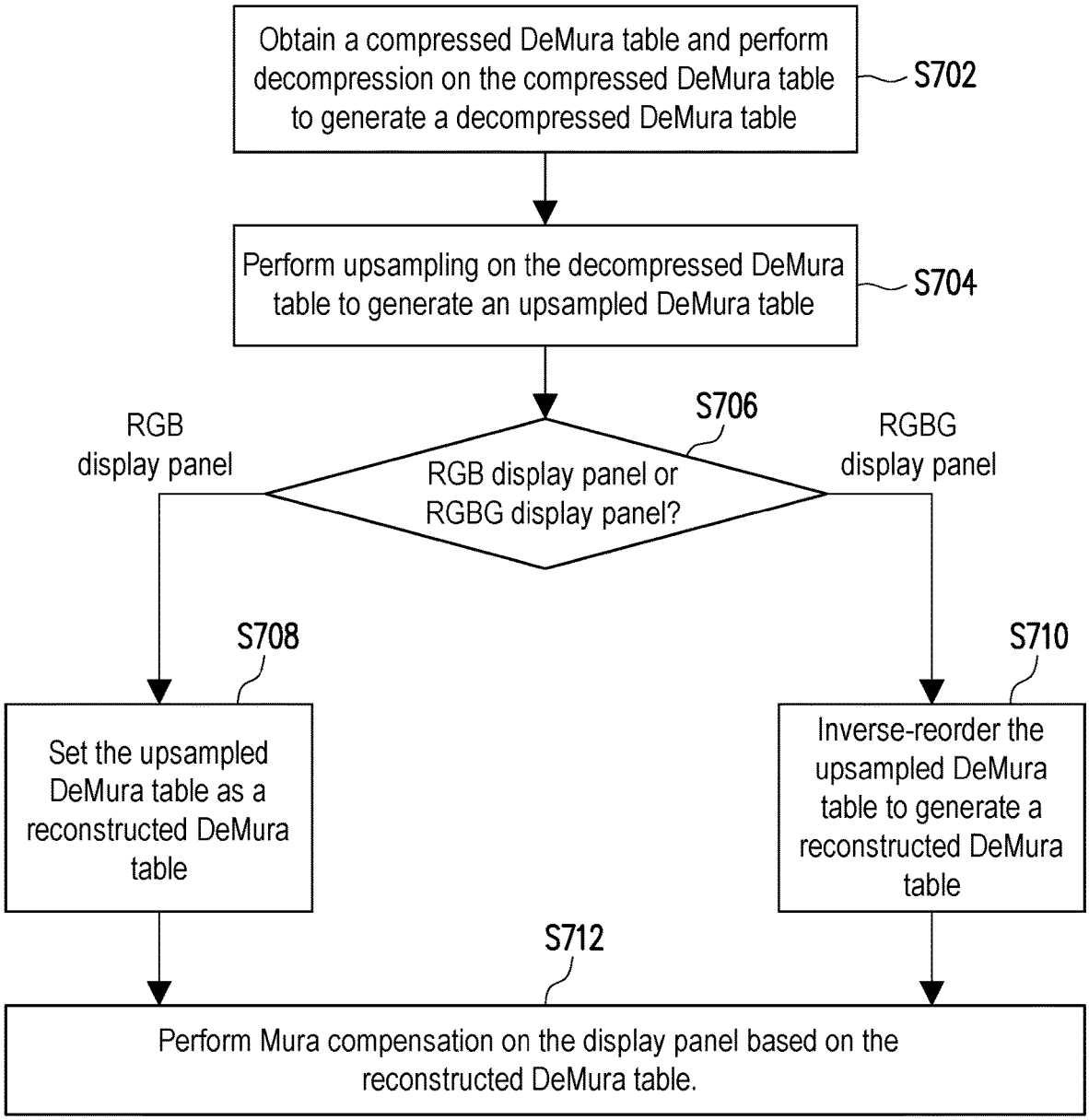
FIG. 7 illustrates a flowchart of a proposed method for Mura compensation on a display panel in accordance with one of the exemplary embodiments of the disclosure.

FIG. 7 illustrates a flowchart of a proposed method for Mura compensation on a display panel in accordance with one of the exemplary embodiments of the disclosure. The steps of FIG. 7 could be implemented by the proposed image processing device 400 as illustrated in FIG. 4. The proposed method in FIG. 7 would be applicable to perform Mura compensation on different types of display panels (e.g. an RGB display panel and an RGBG display panel).

Referring to FIG. 7 in conjunction to FIG. 4, the decompression circuit 410 of the image processing device 400 would obtain a compressed DeMura table corresponding to the display panel 10 from the memory device 20 and perform decompression on the compressed DeMura table to generate a decompressed DeMura table (Step S702). Next, the upsample circuit 420 would perform upsampling on the decompressed DeMura table to generate a upsampled DeMura table (Step 704), for example, as illustrated in FIGS. 3A, 3B and FIGS. 6A, 6B. The inverse-reorder circuit 425 would determine whether the display panel 10 is an RGB display panel or an RGBG display panel (Step S706). When the display panel 10 is an RGB display panel, the inverse-reorder circuit 425 would omit the inverse-reordering process and set the upsampled DeMura table as a reconstructed DeMura table (Step S708). When the display panel 10 is an RGBG display panel, the inverse-reorder circuit 425 would inverse-reorder the upsampled DeMura table to generate a reconstructed DeMura table (Step S710), for example, as illustrated in FIG. 5B. The compensation circuit 430 would perform Mura compensation on the display panel 10 based on the reconstructed DeMura table (Step S712). The details of Steps S702-S712 may refer to the aforesaid paragraphs and would be omitted herein for brevity and ease of description.

Figure 8:
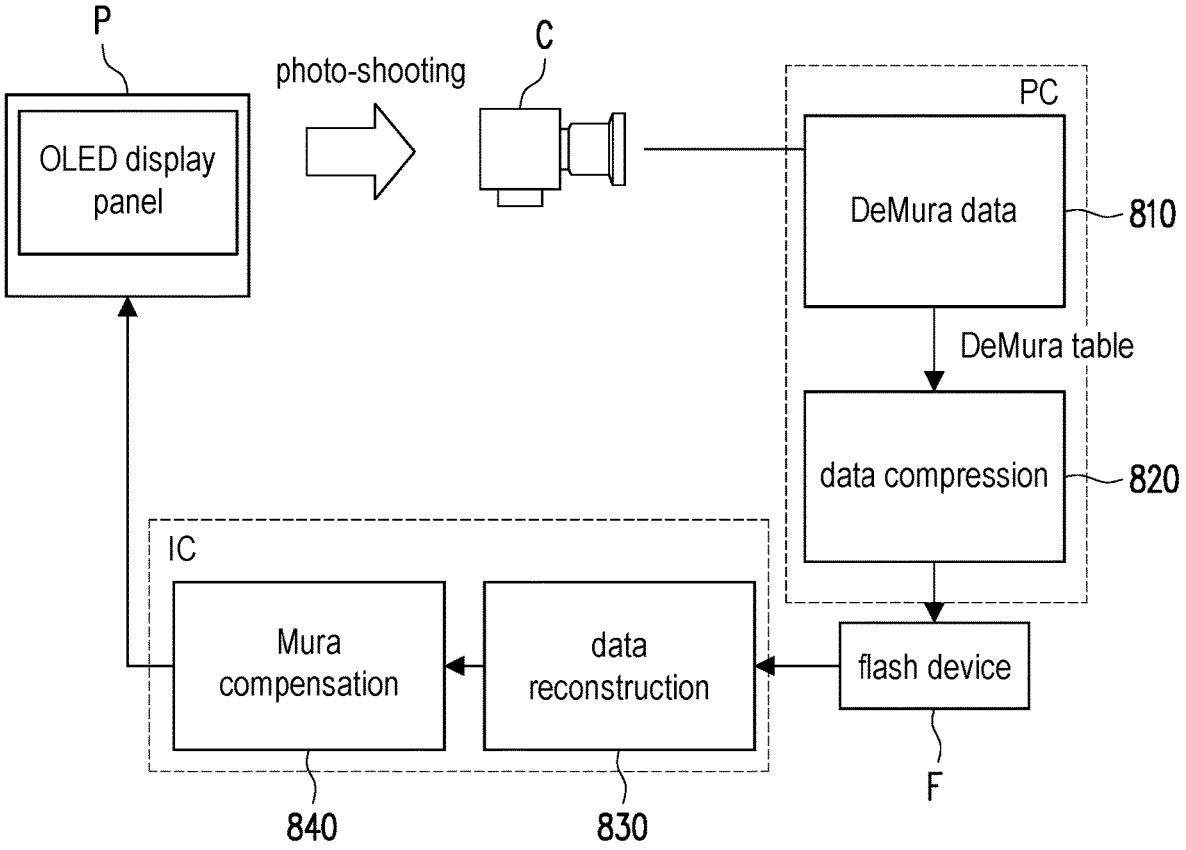
FIG. 8 illustrates a functional diagram of a proposed method for Mura compensation on a display panel in accordance with one of the exemplary embodiments of the disclosure.

From the perspective of the overall system, FIG. 8 illustrates a functional diagram of a proposed method for Mura compensation on a display panel in accordance with one of the exemplary embodiments of the disclosure.

Photo-shooting would be performed on an OLED display panel P through a camera C. At an encoder side PC, DeMura data 810 obtained from the captured image would be processed to generate a DeMura table, and data compression 820 would be performed on the DeMura table to reduce the amount of stored data. The DeMura table would be stored as compressed bit-stream into a flash device F. At a decoder side IC, data reconstruction would be performed on the compressed bit-stream obtained from the flash device F, and the reconstructed data would be used to perform Mura compensation 840 on the OLED display panel P.

In view of the aforementioned descriptions, the proposed Mura compensation technique would not only provide consistent and efficient Mura compensation, but would also be advantageous for storage and cost saving purposes.

No element, act, or instruction used in the detailed description of disclosed embodiments of the present application should be construed as absolutely critical or essential to the present disclosure unless explicitly described as such. Also, as used herein, each of the indefinite articles "a" and "an" could include more than one item. If only one item is intended, the terms "a single" or similar languages would be used. Furthermore, the terms "any of" followed by a listing of a plurality of items and/or a plurality of categories of items, as used herein, are intended to include "any of", "any combination of", "any multiple of", and/or "any combination of multiples of the items and/or the categories of items, individually or in conjunction with other items and/or other categories of items. Further, as used herein, the term "set" is intended to include any number of items, including zero.

Further, as used herein, the term "number" is intended to include any number, including zero.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A method for Mura compensation on a display panel, comprising:

obtaining a compressed DeMura table corresponding to the display panel;

performing decompression on the compressed DeMura table to generate a decompressed DeMura table;

performing upsampling on the decompressed DeMura table to generate a reconstructed DeMura table; and performing Mura compensation on the display panel based on the reconstructed DeMura table, wherein the step of performing upsampling on the decompressed DeMura table to generate the reconstructed DeMura table comprises:

performing upsampling on the decompressed DeMura table to generate an upsampled DeMura table;

determining whether the display panel is an RGB display panel or an RGBG display panel;

in response to the display panel being the RGB display panel, setting the upsampled DeMura table as the reconstructed DeMura table; and in response to the display panel being the RGBG display panel, reordering the upsampled DeMura table to generate the reconstructed DeMura table.

2. The method according to claim 1, wherein the decompressed DeMura table comprises missing data and non-missing data and corresponds to a plurality of subpixels of a plurality of pixels of the display panel, and wherein the step of performing upsampling on the decompressed DeMura table to generate the reconstructed DeMura table comprises:

performing data imputation on the missing data in the decompressed DeMura table to generate the reconstructed DeMura table.

3. The method according to claim 2, wherein the missing data corresponds to a portion of first subpixels of the pixels of the display panel, wherein the missing data comprises first missing data corresponding to a first subpixel of a first pixel among the pixels of the display panel, and wherein the step of performing data imputation on the missing data in the decompressed DeMura table to generate the reconstructed DeMura table comprises:

performing data imputation on the first missing data of the first subpixel of the first pixel based on non-missing data of a first subpixel of at least one neighboring pixel of the first pixel.

4. The method according to claim 2, wherein the display panel is an RGB OLED display panel, wherein the subpixels of each of the pixels of the display panel comprises an R subpixel, a G subpixel, and a B subpixel, and wherein the missing data is located at designated positions in the decompressed DeMura table and corresponds to a portion of the B subpixels and the R subpixels of the display panel, wherein an amount of the missing data corresponding to the B subpixels is greater than or equal to an amount of the missing data corresponding to the R subpixels.

5. The method according to claim 4, wherein the missing data does not correspond to any of the G subpixels of the display panel.

6. The method according to claim 1, wherein the step of performing up-sampling on the decompressed DeMura table to generate the reconstructed DeMura table comprises:

performing upsampling on the decompressed DeMura table to generate an upsampled DeMura table; and performing inverse-reordering on the upsampled DeMura table to generate the reconstructed DeMura table.

7. The method according to claim 6, wherein the decompressed DeMura table comprises missing data and non-missing data and corresponds to a plurality of sub-pixels of a plurality of pixels of the display panel, and wherein the step of performing upsampling on the decompressed DeMura table to generate the upsampled DeMura table comprises:

performing data imputation on the missing data in the decompressed DeMura table to generate the upsampled DeMura table.

8. The method according to claim 7, wherein the missing data corresponds to at least a portion of first subpixels of the pixels of the display panel, wherein the missing data comprises first missing data corresponding to a first subpixel of a first pixel of the display panel, and wherein the step of performing data imputation on the missing data in the decompressed DeMura table to generate the reconstructed DeMura table comprises:

performing data imputation on the first missing data of the first subpixel of the first pixel based on non-missing data of a first subpixel of at least one neighboring pixel of the first pixel.

9. The method according to claim 7, wherein the display panel is an RGBG OLED display panel, wherein the subpixels of each of the pixels of the display panel comprises an R subpixel, a first G subpixel, a B subpixel, and a second G subpixel, and wherein the missing data is located at designated positions in the decompressed DeMura table and corresponds to at least a portion of the B subpixels of the display panel.

10. The method according to claim 9, wherein the missing data corresponds to a portion of the B subpixels and the R subpixels of the display panel, wherein an amount of the missing data corresponding to the B subpixels is greater than or equal to an amount of the missing data corresponding to the R subpixels.

11. The method according to claim 9, wherein the missing data does not correspond to any of the G subpixels of the display panel.

12. The method according to claim 7, wherein the step of inverse-reordering the upsampled DeMura table to generate the reconstructed DeMura table comprises:

obtaining reorder information of the decompressed DeMura table; and performing inverse-reordering on the upsampled DeMura table according to the reorder information to generate the reconstructed DeMura table.

13. An image processing device comprising:

a decompression circuit, configured to obtain a compressed DeMura table corresponding to a display panel and perform decompression on the compressed DeMura table to generate a decompressed DeMura table;

an upsample circuit, configured to perform upsampling on the decompressed DeMura table to generate a reconstructed DeMura table, wherein the upsample circuit performs upsampling on the decompressed DeMura table to generate an upsampled DeMura table;

a compensation circuit, configured to perform Mura compensation on the display panel based on the reconstructed DeMura table; and an inverse-reorder circuit, configured to:

determine whether the display panel is an RGB display panel or an RGBG display panel;

in response to the display panel being the RGB display panel, set the upsampled DeMura table as the reconstructed DeMura table; and in response to the display panel being the RGBG display panel, reorder the upsampled DeMura table to generate the reconstructed DeMura table.

14. The image processing device according to claim 13, wherein the decompressed DeMura table comprises missing data and non-missing data and corresponds to a plurality of subpixels of a plurality of pixels of the display panel, and wherein the upsample circuit performs data imputation on the missing data in the decompressed DeMura table to generate the reconstructed DeMura table.

15. The image processing device according to claim 14, wherein the missing data corresponds to a portion of first subpixels of the pixels of the display panel, wherein the missing data comprises first missing data corresponding to a first subpixel of a first pixel among the pixels of the display panel, and wherein the upsample circuit performs data imputation on the first missing data based on non-missing data of a first subpixel of at least one neighboring pixel of the first pixel.

16. The image processing device according to claim 13, wherein the upsample circuit performs upsampling on the decompressed DeMura table to generate an upsampled DeMura table, and wherein the image processing device further comprises:

an inverse-reorder circuit, configured to perform inverse-reordering on the upsampled DeMura table to generate the reconstructed DeMura table.

17. The image processing device according to claim 16, wherein the decompressed DeMura table comprises missing data and non-missing data and corresponds to a plurality of sub-pixels of a plurality of pixels of the display panel, and wherein the upsample circuit performs data imputation on the missing data in the decompressed DeMura table to generate the upsampled DeMura table.

18. The image processing device according to claim 17, wherein the missing data corresponds to at least a portion of first subpixels of the pixels of the display panel, wherein the missing data comprises first missing data corresponding to a first subpixel of a first pixel of the display panel, and wherein the upsample circuit performs data imputation on the first missing data based on non-missing data of a first subpixel of at least one neighboring pixel of the first pixel.

19. The image processing device according to claim 16, wherein the inverse-reorder circuit obtains reorder information of the decompressed DeMura table and performs inverse-reordering on the upsampled DeMura table according to the reorder information to generate the reconstructed DeMura table.

* * * * *